US005207974A

United States Patent [19]

Yun

[11] Patent Number: 5,207,974

[45] Date of Patent: May 4, 1993

[54] PARTITIONED RECEPTACLE FOR DISTRIBUTING MOLTEN METAL FROM A SPOUT TO FORM AN INGOT

[75] Inventor: David I. Yun, Murrysville, Pa.

[73] Assignee: Aluminum Company of America, Pittsburgh, Pa.

[21] Appl. No.: 737,197

[22] Filed: Jul. 29, 1991

[51] Int. Cl.[5] ..... B22D 45/00

[52] U.S. Cl. ..... 266/230; 266/227

[58] Field of Search ..... 266/227, 230, 236; 222/209, 590, 591, 594

[56] References Cited

U.S. PATENT DOCUMENTS 3,111,732 11/1963 Schroer et al. ..... 222/209

*Primary Examiner*—Scott Kastler

*Attorney, Agent, or Firm*—Alfred D. Lobo; David W. Pearce-Smith

[57] ABSTRACT

Controlling the linear velocity of melt discharge from the discharge outlets of a melt distribution device so as to essentially negate reverse flow from the walls of the mold has been found to produce less oxides and less surface detects in an ingot, particularly an aluminum ingot. This discharge is controlled from the outset of the casting of an ingot because it has been found most defects occur within the initial phase of a cast. A melt distribution device, referred to as a "bag-in-a-bag", is provided which is a pressureless interiorly partitioned receptacle. The partitioning of the receptacle provides an outer bag and a melt-impermeable inner bag in which a pool of melt collects. The pool is deep enough to submerge the discharge end of a spout, to dissipate the kinetic energy of the incoming melt, and to distribute melt from a central zone to discharge zones on either side of the central zone. The discharge zones are provided with outlets through which the melt is discharged at a velocity in the range from about 40 in/min to about 100 in/min depending in part upon the drop rate and the size of the ingot to be cast. Desirable drop rates are in the range from about 2-10 in/min, preferably in the range from 3-7 in/min. A novel starting block is provided which confines the flow of melt so as to form a pool of melt in the center of the mold cavity before the rest of the ingot is cast.

20 Claims, 5 Drawing Sheets

PARTITIONED RECEPTACLE FOR DISTRIBUTING MOLTEN METAL FROM A SPOUT TO FORM AN INGOT

BACKGROUND OF THE INVENTION

This invention relates to a device for distributing molten metal ("melt" for brevity) particularly during the initial phase of pouring the melt into a mold cavity, and doing so without creating an undue degree of turbulence sufficient to result in defects in an ingot which is to be formed upon cooling of the melt. By "mold cavity" I refer not only to a mold cavity in a conventional mold but also to an ingot-defining mold cavity generated by an electromagnetic force field which provides an invisible "mold". The severity of the defects formed, the particular categorization of each defect, the impact of the defects, individually and severally, upon the quality of the ingot produced, and the economics of producing the ingot, will depend upon the metal being cast and the particular method used to cast the metal, inter alia.

Molten aluminum is typically cast into ingots or billets. Ingots are typically rectangular parallelepipeds with a cross-section of about 50 cm (20 ins) thick, and generally more than 1 meter (39.4 ins) wide, with a length in the range from about 2 meters to 6 meters. By the term "about" I refer to a dimension or physical property which one skilled in the art recognizes as being equivalent to the dimension or physical property stated. The thickness is limited because an ingot tends to develop non-uniform microstructures as the rate of cooling the melt decreases. Rate of cooling is measured along lines radiating from the center of the cooling mass, and it is evident that the rate is highest at the surface of the ingot, and it will decrease as the cross-section of an ingot or billet increases. The width of an ingot is usually limited to about 2 meters because a rolling mill is not wide enough to roll a wider ingot. Billets are cylindrical having a diameter in the range from about 61 cm (24") to about 2 meters, and a length in the range from about 2–6 meters.

As one might expect, aluminum ingots and billets are cast by aluminum producers who tend to accept proven production practices and grow accustomed to the necessity of scalping an ingot or billet, more or less, to remove surface and subsurface defects such as cracks initiated by oxides generated during a cast, and oxides trapped in and near the surface. Because a 0.5 in (1.25 cm) difference in the thickness of aluminum scalped from an ingot typically represents a loss of 720 lb aluminum, growing pressures in the market place demand that the inherent waste by scalping be minimized.

I observed that a typical aluminum ingot is most heavily scalped near its bottom (the "butt"), that is, where melt first contacted the bottom and sides of the mold. A typical ingot has 20 cm of aluminum scalped off its bottom. Many ingots are formed with "butt cracks" or, "non-uniform butt curl", which may require scalping an even greater amount from the bottom of the ingot. In addition, the typical ingot has about 3 cm scalped around its periphery where it contacted the sides of the mold.

More specifically, because the pattern of flow from a melt distributor, and the rate of flow therefrom are critically related to the quality of a cast aluminum ingot, this invention relates to a melt distributor for molten aluminum which is to be cast either in a vertical direct chill ("DC") casting process or an electromagnetic casting ("EMC") process.

My melt distributor is partitioned so as to form a 'first' bag partitioned to provide an inner chamber which functions as another ('second') bag built into the first (hence familiarly referred to as a "bag-in-a-bag"). It is adapted to be positioned beneath a spout from which the melt is to be cast in a process which requires submerging the spout in a pool of melt formed within the bag-in-a-bag. This minimizes the splashing of melt within and outside the bag-in-a-bag, thus minimizes the generation of oxides formed during the initial phase of the "cast". The process is effective because it diffuses the kinetic energy of incoming melt (through the spout) sufficiently so as to generate opposed low velocity discharges of melt from the bag-in-a-bag in a characteristic flow pattern which produces no observable reverse flow at the rim of the starting block and the walls of the mold cavity.

The generation of oxides immediately after melt is cast to form an ingot, is further minimized by a base plate (which forms the bottom of the mold) referred to as a "starting block", which has a recessed central portion or "center well".

Currently in use among some producers of cast aluminum ingots is a "sock" of flexible glass cloth, disclosed in U.S. Pat. No. 3,111,732 (Class 222/subclass 209) to Schroer et al., which is tightly tied around a spout to seal the mouth of the sock around the spout. The main purpose of the sock is to filter particulate matter from the melt. To accomplish this, the closeness of the weave corresponds to the size of particles to be filtered. The sock is woven from glass fiber and has insufficient open area to pass as much melt as issues from the spout under pressure generated by a head of melt above the bottom of the trough. The sock is surrounded by another bag the function of which is to distribute the melt after it is filtered.

To effect the desired filtration of melt, which is the emphasized purpose of the relatively close-woven or close-knit glass fiber sock, it is essential to generate a sufficiently high head to overcome the restriction of flow through the cloth. Such high head generates a relatively high velocity of discharge from the sock which is specifically designed to operate under pressure by virtue of being tightly tied around the spout.

In my invention, I use a pool of melt to submerge the spout within my bag, and use overflowing melt from the pool to provide an essentially "pressureless" discharge (so termed because it distributes melt without building up significant pressure) which lowers the velocity of melt being discharged from the submerged spout and onto the starting block in a mold cavity. By the phrases "without building up significant pressure" and "essentially pressureless" operating conditions, I refer to the "head" pressure under which melt is discharged from my bag into a mold cavity. The head pressure is defined by the head of melt which may accumulate in the bag.

The '732 patent requires that the sock extend far enough below the spout to contact melt in the mold cavity. In actual casting practice, contacting the sock with molten aluminum lessens splashing of the metal but the sock has a high proclivity to being caught at the surface by the freezing metal at the end of the cast. This is attributed to the distribution pattern of melt being such as to lower the temperature of the melt near the surface, in a typical "pour" at a typical "drop rate", to near the freezing point.

The '732 patent contains no teaching of the criticality of controlling the initial phase of the pour when there is no melt in the mold cavity. There is no teaching how to position the sock relative to the starting block just before releasing melt into the mold cavity; and, none as to what effect positioning the sock might have on the generation of oxides as a function of the velocity of the melt being discharged from the sock in the first minute or two of the casting of a typical ingot.

Again, in actual casting practice, one skilled in the art using a sock, typically starts a cast by maintaining the bottom of the sock vertically spaced-apart a great distance (about 30 cm) from the surface of the starting block to minimize the risk of freezing the sock to the turbulently advancing surface of melt which tends to solidify in the initial phase of casting an ingot. Such premature solidification of the melt in the initial phase tends to occur at the start of the pour, because there is an insufficient build-up of head inside the sock, and relatively low mass flow and low melt velocity through the sock. Such conditions result in the impact of too little melt on a cold starting block, and the high rate of heat loss from the melt to a water-cooled, highly heat-conductive metal starting block causes melt to solidify essentially instantaneously.

The use of a sock, the bottom of which in actual practice is spaced relatively far away from the upper surface of a starting block, splashes turbulently against the starting block generating oxides which become embedded in the surface as the melt solidifies. Moreover, such relatively far away spacing requires a long time before enough melt is introduced in the mold cavity to submerge the sock, the greater the distance, the longer the time required.

Another currently popular melt filtration and distribution device, also made from glass fiber, is a canoe-shaped bag marketed under the name "COMBO® bag" by Kabert Industries, Inc., Villa Park, Ill., but unlike the sock, is a "pressureless" device. The melt from the spout is filtered and distributed over a designated area within the mold cavity. A more detailed description of this prior art bag is provided hereafter to allow one to visualize its construction clearly.

Still another popularly used melt filtration and distribution device also marketed by Kabert Industries under the brand name of MINI® bag, is a box-shaped open-top receptacle constructed similar to the Combo bag to avoid the pressurized delivery of melt from a "sock". By "open-top" I refer to a top (or mouth) of the bag which is not tied around the spout, or otherwise constricted so as to allow the pressure of the melt to build up in the bag, but is in open communication with the atmosphere in the mold cavity. A more detailed description of this prior art bag is provided hereafter to allow one to visualize its construction clearly. I know of no other bag in current use among aluminum producers in this country.

Irrespective of which currently available bag is used, the vertically spaced apart distance from the starting block is set at the outset of the cast. The bag is positioned by setting the relative distances between the spout, the bottom of the bag, and the starting block, before starting the cast. To set these distances in a typical actual cast, one provides a vertical distance of from about 7.5 cm (3 inches) to about 9 cm (3.5 in) between the bottom of the spout and the top surface of the starting block which forms the bottom of the mold cavity; and, from about 3.5 cm (1.5") to about 5 cm (2") between the bottom of the bag and the top of the starting block.

Like the sock, neither the Combo bag nor the Mini bag are sufficiently effective to control oxide formation, butt cracks and non-uniform butt curl in an ingot. The reason for poor control with the COMBO bag and MINI bag, relative to the control obtained with the bag-in-a-bag of my invention, is that (a) the low level of melt which is maintained in the bag, exposes the discharge end of the spout to atmospheric oxygen, and (b) the vertical impact of the melt on the bottoms of the bags (referred to as "splash platforms") of either the COMBO bag or the MINI bag generates enough metal splash during the start of the cast, and enough surging as a result of waves, to entrap much air.

Enough turbulence and surface waves generate a high level of oxides which adversely affect the economics of ingot production. Some of the oxides are trapped by the solidifying butt shell and may act as initiation sites for butt cracks. The remaining oxides float out to the surface of the melt accumulating in the mold cavity, promote oxidation of metal below, and grow slowly in thickness until they are entrapped on the surface or in the subsurface of the molten ingot as casting proceeds. Patches of entrapped oxide, especially those at the surface, may cause surface cracks and if the ingot does not crack, may require deeper surface scalping for removal than is normally considered economically acceptable.

I realized that most of the defects of a cast ingot (which defects I sought to avoid) appear at the outset of the cast, namely from the initial phase of the casting process, and once formed, are never successfully negated. Therefore I concluded that, if a major improvement in quality of the ingot was to made, the improvement would have to result from an improvement in the flow rate and distribution pattern of melt from the earliest moments during which the melt is introduced into the mold cavity.

To obtain an optimum pattern from the outset of the cast, I concluded I had to diffuse the kinetic energy of the incoming stream within the melt-distribution bag to minimize turbulence when the melt contacted the starting block; and, in addition, that I preferably should confine the flow of melt during its earliest introduction onto the starting block.

To this end I found that the starting block was most effective if its upper melt-contacting surface was not substantially laminar, or only slightly downwardly inclined from either side of the mold cavity towards the center of the starting block, or vice versa, as are conventional starting blocks, but recessed. The recess may be a channel with precipitous side walls, or a center well cut in the block, as will be described in greater detail hereafter. Such a recess must function to confine the initial flow of melt onto the starting block if the recess is to minimize the formation of oxides. Such a recess is not to be deemed equivalent to the cross-shaped recess conventionally cut into the center of the aforementioned starting block (with slightly downwardly inclined surfaces), to lock the ingot being formed, in position within the mold cavity.

It will be recognized that casting aluminum is to commence with a dry starting block, and particular attention is paid to ensure that a "channel" or "center well" in a starting block is dry before starting a pour. In addition, it is desirable to provide drain holes in the bottom of the channel or center well, as well as in other locations in a starting block to minimize the collection of cooling water on the starting block and prevent "bumping" during a cast. The excellent quality of relatively oxide-free ingot obtained by the process of this invention, particularly when used with a channeled, or "center-well" starting block, is evident when compared to the oxide content of an ingot cast with a conventional starting block.

The purpose of redesigning the foregoing prior art bags was to provide a distribution device which was simple, yet effective to distribute melt in the ingot with a minimum of oxide formation, particularly at the outset of a cast, whether as entrapped oxide films, patches, or other undesirable inclusions.

SUMMARY OF THE INVENTION

It has been discovered that a molten metal ("melt") distribution "bag-in-a-bag" having a substantially melt-impermeable inner chamber (also referred to as an "inner bag") and a melt-permeable outer chamber ("outer bag") which is in open communication with the atmosphere in a mold cavity, effectively distributes melt into the mold cavity without producing observable reverse flow at the periphery thereof by providing a pool of melt within the inner bag, into which pool the discharge end of a spout is submerged.

It has further been discovered that a generally rectangular bag-in-a-bag with an open top may be constructed as a partitioned receptacle having a central, inner bag defined by partitions in the receptacle, which inner bag receives melt from a spout; the melt forms a pool in the inner bag, and the discharge end of the spout is submerged in the pool. Melt overflows two opposed sides of the inner bag into discharge zones (headers) and is discharged at relatively low velocity in opposite directions, into a casting zone where the melt is cooled to form an ingot of arbitrary cross section, having fewer defects due to formation of oxides than an ingot formed from the same melt using a prior art bag.

It is therefore a general object of this invention to provide a melt distribution bag-in-a-bag comprising a substantially impermeable built-in inner bag having upstanding side walls and a planar base member ("inner bag floor") in a box-shaped outer bag which is partitioned to provide opposed, spaced-apart discharge zones for the melt. The inner bag provides a pool of melt in which the spout is submerged so that the kinetic energy of incoming melt is substantially dissipated. The melt overflows the inner bag and spills into the discharge zones which are essentially pressureless and separated from the inner bag by opposed spaced-apart partitions, each zone being provided with at least one discharge port having an open-mesh screen filter means through which melt is filtered, and at least a portion of the melt is discharged laterally into a mold cavity.

It is another general object of this invention to provide a generally rectangular box-shaped bag-in-a-bag having an outer bag and an inner bag adapted to be disposed in melt-receiving relationship under the discharge end of a spout, the outer bag having a planar base and upstanding opposed side walls and end walls, the end walls being shorter than said side walls. A central melt-distribution zone is provided by laterally spaced-apart upstanding partitions extending transversely from one side wall to the other so as to form the inner bag which is melt-impermeable and centrally located within the outer bag; at least each end wall of the outer bag has an open-mesh discharge outlet therein, near the bottom thereof so that the outer bag has at least two opposed discharge outlets, and the combined area of the discharge outlets is sufficiently large to provide substantially no accumulation of melt in a discharge zone so that melt is discharged with essentially no pressure drop across each discharge outlet.

It has further been discovered that a "bag-in-a-bag" may be positioned under a spout and above the center of a mold in which an ingot of generally cylindrical cross section (referred to as a "billet") is to be cast in an billet-defining mold cavity, the bag-in-a-bag comprising, an open-top generally cylindrical outer bag having a substantially planar base member and a peripheral outer wall rising from the periphery of the base member; an essentially melt-impermeable inner bag disposed upon the base member and within the outer bag, the inner bag being defined by a cylindrical inner wall rising from the base member so as to retain a pool of melt large enough to submerge a melt-discharging spout within the inner bag; the cylindrical inner wall and the peripheral outer wall providing an annular discharge zone into which melt overflows from said inner bag, said inner wall having a circumferential discharge outlet in the peripheral outer wall near the bottom thereof, the area of the discharge outlet being sufficiently large to filter the melt into the mold cavity without providing substantial accumulation of the melt within the discharge zone.

It has also been discovered that the velocity of melt discharged from the spout may be substantially decreased without decreasing the rate of flow of melt being cast into a mold cavity by forming a pool of melt in a central distribution zone within a melt-distribution bag, submerging the discharge end of the spout in the pool and causing melt to overflow partitions which confine the pool; and, discharging the overflow with essentially no accumulation of melt, in opposed directions, from discharge zones on either side of the pool, at a linear melt velocity lower than that required to produce an observable reverse flow from the walls of the mold cavity, or from the rim of the starting block, if the block has a rim.

It is therefore a general object of this invention to provide a process for casting an ingot comprising, (a) accepting incoming melt from a spout by positioning the discharge end thereof in a melt-impermeable central distribution zone having a depth sufficient to submerge the discharge end of said spout in the initial portion of a cast, (b) confining the incoming melt in said central distribution zone until melt overflows into a contiguous discharge zone so that at least some of the melt is discharged laterally into a a mold cavity; and, (c) discharging overflowing melt from said discharge zone under essentially no pressure, through a discharge outlet substantially without accumulating melt within said discharge zone so that melt is discharged therefrom at a linear melt velocity lower than that required to produce an observable reverse flow from the rim of the starting block or the walls of the mold cavity.

It is another general object of this invention to provide a process for casting an ingot comprising, (a) accepting incoming melt from a spout by positioning the discharge end thereof in a melt-impermeable central distribution zone, (b) confining the incoming melt in said central distribution zone until melt overflows into contiguous opposed discharge zones on either side of said central distribution zone, and, (c) discharging overflowing melt from the discharge zones under essentially no pressure, through discharge outlets having a combined area insufficient to provide substantial accumulation of melt which is discharged at a linear melt velocity lower than that required to produce an observable reverse flow from the walls of the mold cavity, or the rim of the starting block, if the block has a rim.

It has still further been discovered that a melt flow pattern in which there is no observable reverse flow at the rim of the starting block or the walls of a mold cavity, can be obtained with any melt-distribution bag or receptacle provided it is positioned above and in close proximity to the bottom of a central recess, whether a "channel" or "center. well", in the upper surface of a starting block. The starting block may be rectangular or circular depending upon whether an ingot or a billet is to be cast. The central recess has an upstanding peripheral wall at an angle from 45° to 90° to the base of the recess, which wall restricts initial flow to form a pool of melt therewithin before melt is flowed across the upper surface.

It is therefore a general object of this invention to provide a recessed starting block for an ingot of metal to be formed within a mold in which said starting block is removably fitted; the starting block has a generally laminar upper surface and a thickness sufficient to provide a central recess in its upper surface, the recess having a substantially planar bottom surface having an area greater than area of the upper surface; the upstanding peripheral wall may be circular or rectangular, and rises from the bottom surface, at a height being sufficient to confine melt discharged within the recess until the melt forms a central pool within the recess.

BRIEF DESCRIPTION OF THE DRAWINGS

The foregoing and additional objects and advantages of the invention will best be understood by reference to the following detailed description, accompanied with schematic illustrations of preferred embodiments of the invention, in which illustrations, like reference numerals refer to like elements, and in which.

DETAILED DESCRIPTION OF PREFERRED EMBODIMENTS

The prior art "sock" is adequately described in the aforementioned '732 patent, but neither the Combo nor the Mini bags are described in any publication known to me. Therefore, to provide a visual appreciation of the structure of the Combo and Mini bags, and how the structure of my bag-in-a-bag differs from each of the others, a brief but adequately detailed description of the Combo and Mini bags is first provided herebelow.

Figure 1:
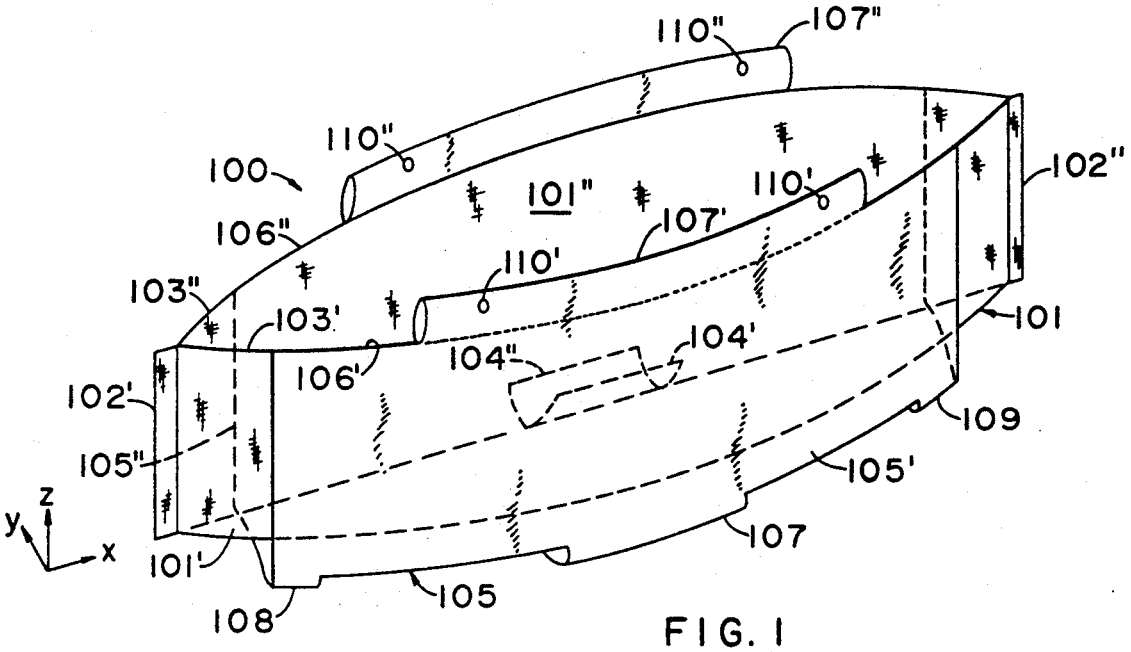
FIG. 1 (PRIOR ART)
FIG. 1 is a diagrammatic perspective, slightly elevational view, of a prior art COMBO ® bag.

Referring first to FIG. 1 there is shown the Combo bag referred to generally by reference numeral 100, which comprises an inner sling 101 formed from a generally rectangular open-mesh piece of fabric woven from glass fiber yarn, the fabric having mesh openings about 2 mm (0.1") square. The fabric is folded upon itself along a longitudinal center line of the rectangle (x-axis in the Figure) so as to form the inner sling having sides 101' and 101", mirror-images of one another, which are heavily sewn or otherwise secured along their edges 102' and 102" so as to form the open-mesh inner sling having closed sides (or ends) 102' and 102". As illustrated, the sides are pushed slightly towards the vertical center line of the sling so that the top edges 103' and 103" of the sides 101' and 101" present an elliptical form, and the sling's mouth (top of the bag) is open. The sides 101' and 101" ("lateral sides" or "longitudinal walls") of the sling 101 are longer along the x-axis than the sides 102' and 102" are high ("vertical sides", z-axis).

The central portion of the bottom of the open-mesh sling 101 is provided with a splash-arrester of melt-impermeable glass fabric having sides 104' and 104" which are sewn into, and foldedly extend a short distance substantially vertically along each of the sides 101' and 101" of the folded open-mesh sling. The area of the splash arrester is sufficient to stop and deflect the initial surge of incoming melt. When the closed ends 102' and 102" of the open-mesh sling are further pushed closer towards each other than is illustrated in the FIG. 1, the radii of the elliptical sides is decreased causing the mouth of the bag to present a more circular form, and the bottom of the bag tends to flatten out in the x-y plane, as do the sides 101 and 101', so that the sides 104' and 104" of the splash arrester lie, near the longitudinal bottom of the sling, transversely in the x-y plane on opposite sides of the x-axis.

The open-mesh sling 101 is nested within, and closely supported by contact with, a rectangular outer sling 105 of tightly woven substantially impermeable glass fabric (referred to as a "closed-mesh sling"), open at the top, and substantially open at the bottom, the sling having lateral sides 105' and 105". The upper edges of the inner and outer slings 101 and 105 are sewn together forming seams 106' and 106".

The sides 105' and 105" of the outer sling are connected along portions of their bottom edges by three transverse strips of melt-impermeable fabric, a central 107, and two side 108 and 109 strips respectively, the side strips being disposed on either side of the central strip. The strips are referred to as transverse strips because they extend in the transverse direction to connect the sides 105' and 105" of the outer sling. Each strip is sewn or otherwise fastened along the x-axis at the longitudinal center line of the strip, to the bottom of the inner sling. The extent to which each strip extends along the x-axis determines how much of the inner open-mesh sling is in essentially open fluid communication with the mold cavity.

The sides 105' and 105" extend vertically above the seams 106' and 106" and are folded upon themselves so that they may be secured to form sleeves 107' and 107". As illustrated, the sleeves do not extend the length of the sides 105' and 105" but only over a major portion thereof, the sleeves extending on either side of the vertical center line of the bag 100. The function of the sleeves is to provide support for the Combo bag when it is pendantly disposed under the spout of a tundish by means of support arcuate support rods (not shown) so that there is a relatively low-pressure distribution of melt, the pressure being determined mainly by the head of melt in the inner open-mesh sling, and not the tundish (as when a sock is used). To increase the pressure on melt in the inner sling, the sleeves 107' and 107" are provided with holes 110' and 110" through which wire (not shown) may be passed and tightly trained around a spout to secure the bag 100 thereto.

After directly impinging upon and being deflected by the sides 104' and 104" of the splash arrester 104, melt is discharged from opposed discharge zones of the bag. Each discharge zone extends from a transverse edge of the splash arrester 104 to the end of the inner open-mesh sling. Because each discharge zone is bisected near the bottom thereof by the transverse side strips 108 and 109, and at the zone's end by the sewn sides 102' and 102", the melt leaves each zone as a pair of bifurcated streams in flow patterns which are essentially mirror images of one another in the x-z plane. Each bifurcated stream has (i) a vertical z-axis component which flows directly downward into the mold cavity through the open bottom of the inner sling, (ii) a longitudinal x-axis component which flows initially mainly in the longitudinal direction (directed toward the shorter vertical sides of the mold), and (iii) a transverse y-axis component (directed towards the lateral sides of the mold). When the velocities of the x-axis and y-axis components decrease, the flowing melt arcs downwards into the mold cavity. Depending upon the mass flow of incoming melt, and particularly because the sides 101' and 101" of the sling 101 are secured along a melt-impermeable vertical edge, the sum of the mass flow of y-axis and z-axis components is substantially greater than that of the x-axis component.

Figure 2:
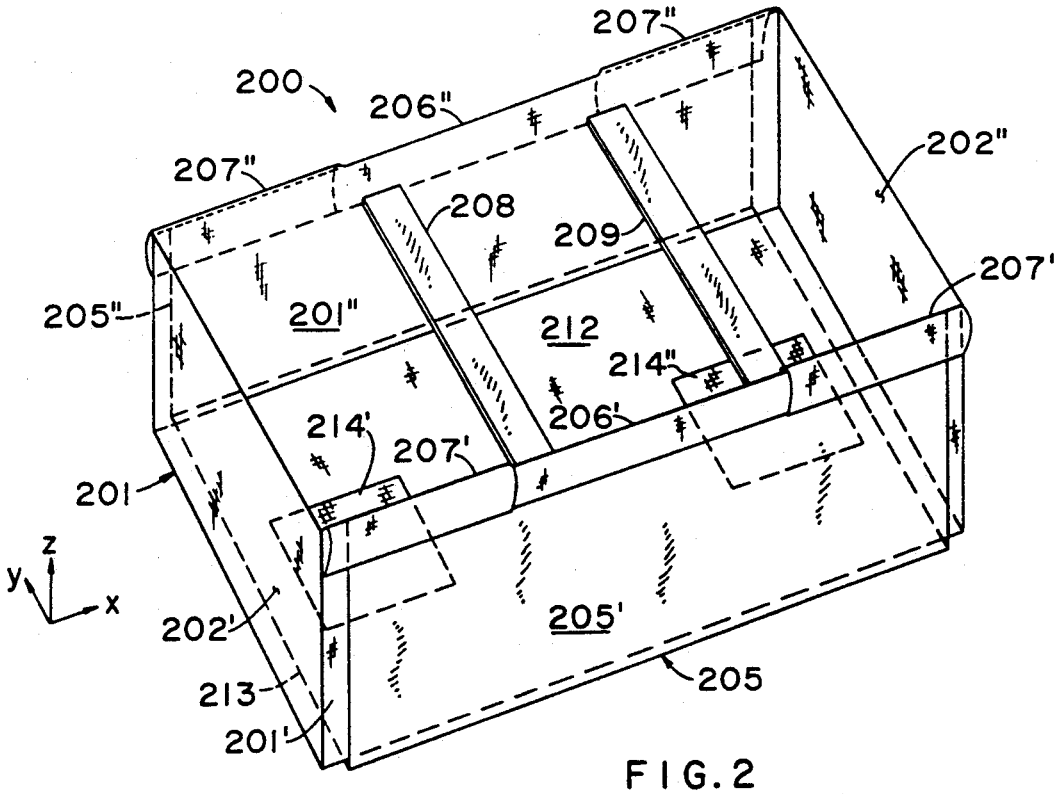
FIG. 2 (PRIOR ART)
FIG. 2 is a diagrammatic perspective, slightly elevational view, of a prior art MINI ® bag.

In an actual cast with a Combo bag, the combined mass flows from the components (along each of the three axes) of each bifurcated stream is such that the failure of the sides 104' and 104" of the splash arrester, and the sides of the sling 105, to dissipate sufficient kinetic energy in the incoming melt results in an observable reverse flow from the side walls and end walls of the mold. No effort is made to "tailor" the mass flow in the y-axis (or any other) component because the criticality of the velocity and mass flow of the discharged melt during the first minute or so of a cast has, to date, not been recognized. To avoid the pressurized delivery of -melt as in the sock (the '732 patent), another currently popular melt filtration and distribution device known as MINI® bag, is used, also marketed by Kabert Industries. As illustrated in FIG. 2, an elongated rectangular bag referred to generally by reference numeral 200, also made of glass fiber, replaces the sock. Because of its structural similarity to the Combo bag described hereinabove, corresponding reference numerals are used insofar as is consistent with clarity, except that the numerals chosen start with 200, the other digits being the same.

The Mini bag comprises an inner substantially rectangular trough 201 and an outer sling 205. The trough is formed from open-mesh fabric woven from glass fiber yarn, the fabric having mesh openings about 2 mm (0.1 in) square. The fabric is sewn so that the trough has side walls (lateral sides) 201' and 201", and end walls (transverse sides) 202' and 202". The upper portions of the side walls 201' and 201" are folded upon themselves and securely fastened to form sleeves 207' and 207" about an inch high, sufficient to afford passage for a supporting rod on each side of the trough.

As illustrated in FIG. 2, the sleeves do not extend the full length of the sides 205' and 205" but only over a major portion thereof, on either side of the vertical center y-z plane of the bag 200. The function of the sleeves is to provide passage for supporting means for the Mini bag when it is pendantly disposed under the spout of a tundish by means of support rods (shown in FIG. 4). So disposed, with the top of the trough open to the atmosphere, there is essentially no pressure exerted on the melt in the trough. The melt distributed from the trough leaves by virtue of essentially only the kinetic energy of the incoming melt.

The side walls 201' and 201" of the trough 201 are longer (along the x-axis) than the end walls 202' and 202" are high ("transverse sides" the height of each of which is measured along the z-axis). The bottom 212 of the trough 201, like its side walls and end walls, is a continuous substantially rectangular piece of open mesh glass fabric. Thus the trough is simply an open mesh rectangular receptacle with an open top.

Strips 208 and 209 of tightly woven glass fabric are sewn into the upper portions of the side walls 201' and 201", connecting them, so as to facilitate hanging the Mini bag in position under a spout.

The side walls 201', 201" and bottom 212 of the open-mesh trough 201 are exteriorly covered, except near their ends, and closely supported, by contact with a rectangular outer closed-mesh sling 205, which cradles the trough. The upper edges of the sling are fastened to the upper edges of the trough 201. The sides 205' and 205" of the outer sling 205 are melt-impermeable, but the sling's bottom 213 is provided with openings 214' and 214" which are oppositely disposed along the x-axis near the transverse edges of the bottom 213. Since the trough has open-mesh end walls 202' and 202", is open near the ends of its side walls 201' and 201", and has openings 214' and 214" in its bottom, there is essentially no opportunity for melt to accumulate in the trough. Therefore the spout is not submerged in a pool of melt.

The upper edges of the trough 201 and outer sling 205 are sewn together forming seams 206' and 206", the upper portion of the sling serving to reinforce the sleeves 207' and 207". The bottom 213 serves as a splash arrester for incoming melt.

After directly impinging upon the bottom 212 of the trough which is backed by the melt-impermeable bottom 213 of the sling, melt is discharged from opposed discharge zone of the bag. Each discharge zone extends from a transverse edge of sling's bottom to the end wall of the trough. Since there is essentially no impediment to flow of the melt through the open-mesh end walls which together have an area at least twice as great as that of the combined area of openings 214' and 214", most of the melt is discharged through the end walls.

The discharge at each end of a Mini bag has (i) a vertical z-axis component which flows directly downward into the mold cavity through the opening 214' in the bottom of the outer sling, (ii) a longitudinal x-axis component which flows initially mainly in the longitudinal direction (directed toward the shorter vertical sides of the mold), through each end wall, and (iii) a relatively small transverse y-axis component (directed towards the lateral sides of the mold), smaller than either (i) or (ii) which is discharged through the side walls of the trough, near the ends thereof, where the outer sling does not cover the side walls.

As with the Combo bag, the flow of each discharge from the Mini bag arcs downwards into the mold cavity as the velocity of the x-axis and y-axis components decrease. However, the sum of the mass flow of x-axis and z-axis components is substantially greater than that of the y-axis component.

In an actual cast with a Mini bag, the combined mass flows from the three components of each discharge stream is determined by the failure of the bottom of the outer sling to dissipate sufficient kinetic energy in the incoming melt, and there is an observable reverse flow from the side walls and end walls of the mold. This is substantially the same phenomenon observed with the Combo bag and, again, no effort has been made to date, to "tailor" the mass flow of the flow component in the x-axis (or any other) because the criticality of the velocity and mass flow of the discharged melt during the first minute or so of a cast has not been recognized.

From the foregoing it is now evident that the Combo and Mini bags each having a central planar arresting means for incoming melt which fails to submerge the discharge end of the spout. The unsubmerged spout transfers too much kinetic energy to the discharged streams which must then dissipate the energy against the walls of the mold, resulting in deleterious reverse flow.

The Combo bag is typically not tied around the spout, and the Mini bag cannot be, so that the distribution of melt from each bag is under essentially no pressure ("pressureless"), except for the slight pressure exerted by the head of melt which is present just before the melt is discharged.

The construction (described herebelow) of my melt distribution bag, referred to herein as a bag-in-a-bag (and simply "bag" for brevity), is glass fiber which is woven into a fabric. Except for designated portions of the bag which are of open-mesh construction, the fabric is melt-impermeable. Though glass fiber is preferred for economy, its choice is not narrowly critical. Any material which will withstand the high temperatures and forces to which the bag is subjected, and which remains essentially unreactive with the melt, may be used. Tightly woven glass cloth is used for the inner bag (central compartment of the bag) which is to retain melt, and an open-mesh weave having essentially no resistance to melt flow under the conditions of use, is used in appropriate location of the opposed discharge headers (side compartments) through which melt is to be discharged.

Figure 4:
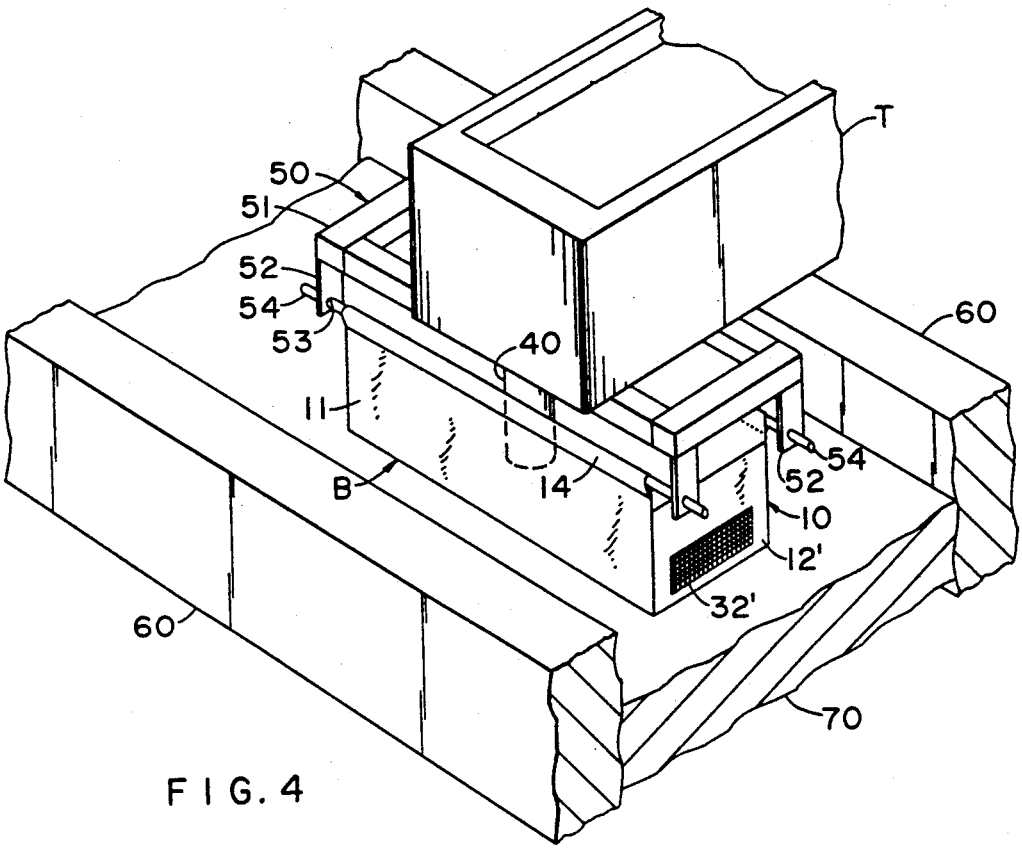
FIG. 4 is a diagrammatic perspective view of the bag-in-a-bag illustrated in FIG. 3, positioned with supporting and fastening means, under a spout of a tundish, the spout being within a mold cavity.

A bag constructed with glass fiber cloth having requisite permeability is flexible and foldable into a relatively flat configuration. The bag acquires a rectangular configuration when disposed in melt-receiving relationship with the spout, when using suspending and fastening means attached to the bottom of a tundish or trough as shown in FIG. 4. An equally effective bag may be constructed from a yarn of refractory material referred to as "ceramic fibers" such as NEXTEL®, FIBERFAX®, and KAOWOOL® alumina-silica fibers available from Minnesota Mining and Manufacturing Corp., Sohio Engineered Materials Company (Carborundum), and Thermal Ceramics Inc. respectively, or NICALON® silicon carbide fiber, available from Dow Corning Corporation; or, FPR alumina fiber available from E. I. duPont deNemours Company, but the glass fiber cloth bag is most preferred.

Neither is the shape of the bag critical, though for reasons which will be more fully stated hereinbelow, it will be evident that it is preferred, for optimum operation, to correlate the shape of the bag to that of the mold cavity in which the bag is to be used. Thus, in a typical, generally rectangular parallelepiped mold cavity, a bag of similar geometry is most effective. If the mold cavity was cylindrical, a cylindrical bag would be most effective.

When the configuration of the mold cavity is a generally rectangular parallelepiped two sides of which are longer than the others, the bag is approximately correspondingly configured, and its rectangular base is constructed so that the melt is discharged at least from the vertical walls of the bag through opposed open-mesh outlets in the lower portion of the walls. Preferably, in addition to being discharged through the vertical walls, the melt is discharged through the bottom of the bag, near the ends thereof. By "the ends" of the bag I refer to the two (narrower) ends defined by the shorter sides of the bag's rectangular base.

When the configuration of the mold cavity is cylindrical, the bag is most preferably chosen so that the melt is discharged from a circumferential open-mesh outlet in the cylindrical vertical wall, in the lower portion thereof. Preferably, in addition to being discharged from the vertical wall, the melt is discharged through the bottom of the bag, near the periphery thereof.

Figure 3:
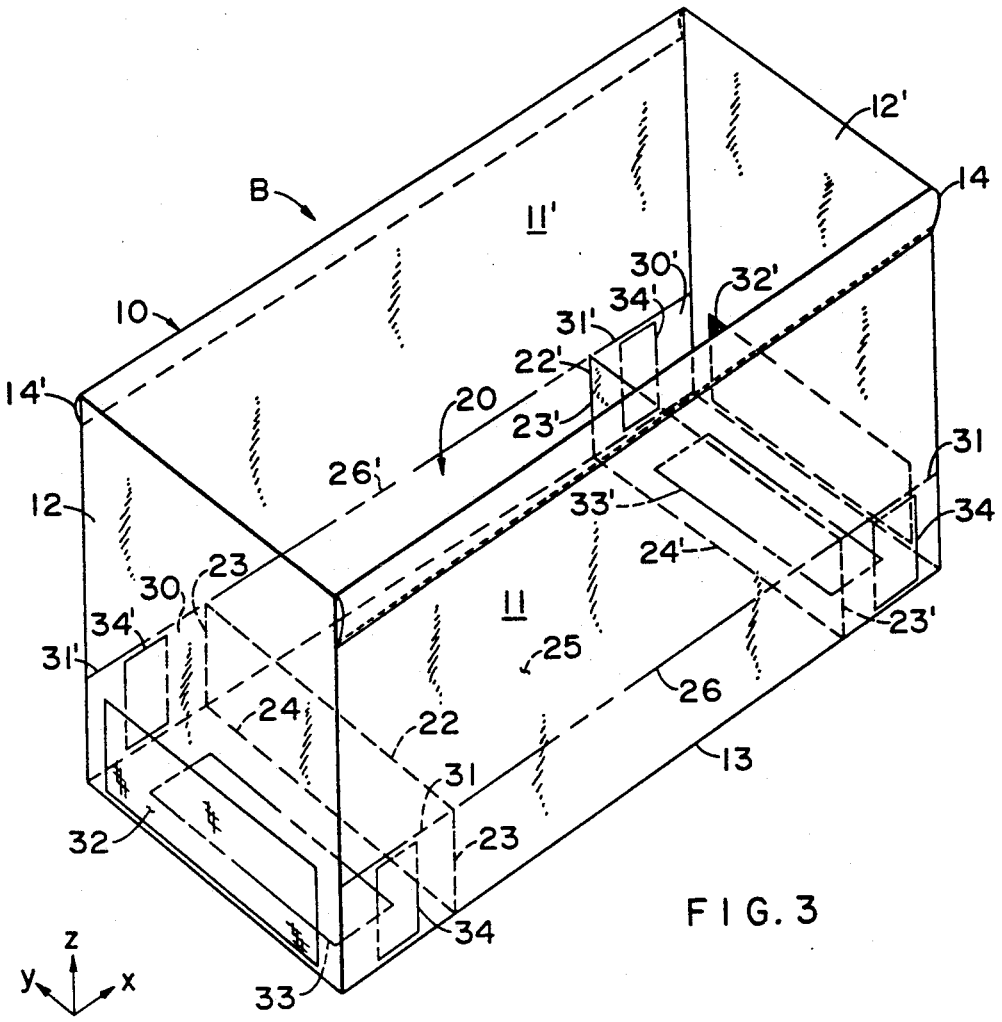
FIG. 3 is a diagrammatic perspective, slightly elevational view of a generally rectangular box-shaped open top bag-in-a-bag showing the partitions and open mesh areas.

Referring to FIG. 3, there is shown the bag B which comprises an external bag referred to generally by reference numeral 10, having upstanding transversely (y-axis) spaced-apart vertical side walls 11 and 11', and laterally (x-axis) spaced-apart vertical end walls 12 and 12', the walls rising from the periphery of a planar base 13. The upper portions of the side walls 11 and 11' are folded upon themselves and secured so as to form sleeves 14 and 14' adapted to receive supporting means to support the bag in position for a cast. The bag is positioned as shown in FIG. 4 under the spout 40 by supporting and fastening means indicated generally by reference numeral 50 so that the lower end of the spout 40 is in the lower zone defined by the lower one-half volume of the bag, and more specifically, placed below a plane through the upper edges of partitions 22 and 22' of the "inner bag" 20 as will be described herebelow.

The supporting and fastening means 50 comprise a rectangular metal frame 51 which is removably attached to the bottom of the tundish T from which melt flows through the spout 40 into the bag B. The frame 51 is provided near its corners with four straps 52 hanging vertically, one at each corner, the straps having bores 53 through which supporting rods 54 are removably inserted. To hang the bag B, a supporting rod 54 is inserted through each of two sleeves 14 and 14', one near the upper edge of each side wall of the bag. An alternative means for supporting the bag in position is to clamp it to the straps or to the frame with spring clamps. It will be appreciated that the sleeves are provided solely to adapt the bag to the supporting and fastening means used to position it under the spout. No sleeves would be necessary if the periphery of the bag is to be clamped to a supporting frame. The bag is positioned centrally over the starting block 70, at a predetermined height thereabove, and within a mold having side walls 60 (the end walls are not shown).

The side walls 11 and 11' are connected by opposed laterally spaced-apart partitions 22 and 22' which extend vertically for a minor portion of the height of the vertical walls of the external bag 10, preferably for about one-fifth to one-half the height thereof. The partitions 22 and 22' are made from tightly woven glass fabric which is impermeable to melt. The partitions are fastened along their vertical edges 23 and 23' to the side walls so as to seal the edges to the walls; and, also along their transverse bottom edges 24 and 24' to seal them to inner bag floor 25 which is commonly shared with the planar base 13 of the bag. This sealing is typically done by sewing the panels to the fabric of the walls and planar base of the external bag 10. Thus the partitions 22 and 22' serve to partition the lower zone of the bag into three compartments, namely, a central compartment referred to as the inner bag 20 (skim pan), and opposed laterally spaced-apart "discharge headers" 30 and 30', so termed because all the melt must be discharged through them.

The inner bag is defined by the partitions 22 and 22', the inner bag floor 25, and the opposed mirror-image portions of the side walls 11 an 11', the partitions and opposed portions rising from the planar base 13. These opposed portions of the side walls 11 and 11' are defined by the phantom lines 26 and 26', each along the x-axis, connecting the upper corners of the panels 22 and 22'.

The partitions are typically in the range from about 5 cm (2 in) to about 15 cm (6 in) high, the height being chosen to form a pool of melt in which the spout 40 may be submerged to absorb and diffuse the kinetic energy of the incoming melt.

Referring to discharge header 30, which is substantially identical to discharge header 30', it is the space defined by the partition 22, the corresponding opposed portion of the transverse wall 12, and the opposed portions of the side walls 11 and 11', all rising from the planar base 13. These opposed portions of the side walls 11 and 11' are defined by the phantom lines 31 and 31', each along the x-axis, connecting the upper corners of the panel 22 to the transverse wall 12.

Analogously, the space occupied by discharge header 30, is defined by the partition 22', the corresponding opposed portion of the end wall 12', and opposed portions of the side walls 11 and 11' (not identified by reference numerals).

It will now be evident that the inner bag 20 shares its lateral side walls (the upper edges of which are identified by phantom lines 26 and 26'), with the side walls 11 and 11' of the external bag 10, and shares its bottom 25 with the bottom 13 of the external bag. As such, the partitions 22 and 22' define an internal bag within the external bag, but to avoid confusion, the internal bag is referred to as a "inner bag" which defines its traditional function except that my inner bag 20 has an imperforate bottom (inner bag floor) 25 bounded by the partitions 22 and 22'. The function of the inner bag is to provide a pool of melt which submerges the discharge end of the spout 40 to dissipate kinetic energy of the melt.

The portion of the end wall 12 shared by discharge header 30 is provided with an open-mesh outlet 32 near the bottom of the wall, through which melt is discharged along the x-axis (laterally). The ratio of the area of the open-mesh outlet 32 to that of the end wall 12 is chosen so as to allow the external bag 10 to provide the desired discharge of melt without accumulating it to a level where it spills over the open top of the bag. Typically the open area of the outlet 32 is less than the area of the panel 22. Another outlet 32', a mirror-image of outlet 32, is provided in the opposed end wall 12'. The area of the outlet 32 is further affected by whether additional, optional outlets are provided for the discharge header.

Such an optional outlet 33 may be provided in the bottom of the discharge header 30. Still other optional outlets may be provided and in the opposed portions of the lateral walls 11 and 11' (which opposed portions help define the discharge header), as are the outlets 34 and 34'. Whichever combination in discharge header 30' to ensure a symmetrical flow discharge and distribution of melt in the mold cavity.

As one skilled in the art will appreciate, the rate at which an ingot is cast is defined by constricting variables which balance the desirability of casting it as quickly as possible, the ability to cool the incoming melt adequately during the time it is being poured into the mold cavity, and other factors which necessitate the ingot be cracks. For example, an ingot with a nominal 51 cm×102 cm (20"×40") cross-section is desirably DC cast at a drop rate of at least 2"/min so that the volume flow is 1600 $in^3$/min. The open-mesh area in a discharge zone is large enough to generate a discharge velocity of no more than about 100 in/min, but not so large as to generate a velocity less than about 40 in/min. At a higher velocity than 100 in/min an observable reverse flow is likely, and at a lower velocity than 40 in/min, premature freezing of the melt is likely.

A larger ingot having a nominal 20"×60" cross-section (say) would require a larger open-mesh area to be cast at a comparable drop rate. The open-mesh area required will, in major part, determine if additional optional openings 32 and 34 will be required. The bag preferably has an open-mesh area in the range from about 70 $in^2$ to about 140 $in^2$.

Figure 5:
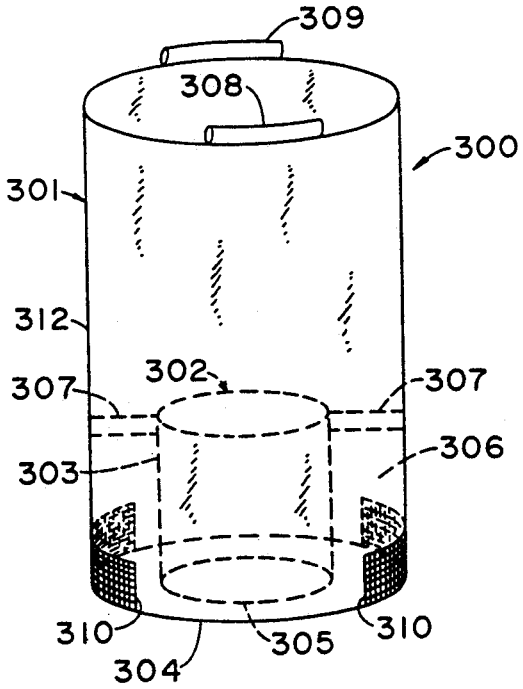
FIG. 5 is a diagrammatic perspective, slightly elevational view of a generally cylindrical barrel-shaped open top bag-in-a-bag showing the cylindrical inner partition and open mesh area in the outer peripheral wall, near the bottom thereof.

Though ingots having a generally rectangular cross section are cast most frequently, billets having a circular cross-section (in a plane at right angles to the longitudinal axis of the mold cavity) may also be cast. To do so, there is schematically illustrated in FIG. 5 a cylindrical bag-in-a-bag identified generally by reference numeral 300 having an outer bag 301 within which an inner bag 302 is coaxially disposed on the circular base 304 of the outer bag so as to provide an annular discharge zone 306. The inner bag 302 is a cylindrical sleeve 303 of melt-impermeable close-woven refractory fiber, such as glass fiber yarn, attached along the sleeve's lower periphery to the base 304 by sewing the sleeve to the base, so that the outer bag 301 shares its base 304 with the inner bag but melt from the inner bag is sealed within the bag unless the melt overflows. Alternatively, the inner bag may be constructed with a base 305 which is then attached to the base 304 to ensure against leakage from around the base of inner bag 302. The inner diameter of the inner bag 302 is large enough to allow the discharge end of a spout to be loosely slipped into it, ensuring that the inner bag is "open", that is, in open communication with the atmosphere.

As with a rectangular bag-in-a-bag, the height of the sleeve 303 is a minor portion of the height of the peripheral wall of the outer bag 301, extending from one-fifth to one-half the height thereof. The inner bag 302 is centrally positioned by fastening its sleeve 303 to the wall 312 of the outer bag 301, with plural locating straps 307 (two are shown). Thus the sleeve 303 serves to partition the lower zone of the bag 300 into two compartments, namely, a central distribution zone and a contiguous annular discharge zone 306. To discharge melt from the discharge zone, a filter member 310 is provided in the wall of the outer bag 301.

Since the cylindrical bag-in-a-bag 300 is used to cast a billet which in turn requires a cylindrical starting block, the melt is preferably discharged radially from the discharge zone 306, through a peripheral open mesh screen 310 of woven glass yarn having a mesh size small enough to filter out undesirably large solid particles. As before, the open area provided by the peripheral screen 310 is sufficient to provide a discharge velocity in the range from 40 in/min to 100 in/min. Though as shown, the screen 310 is provided near the bottom of the peripheral outer wall it may be located higher provided at least a portion of the outlet extends below the level of the periphery of the inner bag 302, and such portion provides the requisite open area.

To facilitate positioning the bag 300 under a spout, sleeves 308 and 309, referred to as peripheral sleeves because they are attached to the periphery of the outer bag 301, are provided and extend for a sufficient length along the periphery to permit arcuate support rods (not shown) to be inserted in the sleeves. The rods are held in a support frame constructed in a manner analogous to that described hereinabove.

Figure 9:
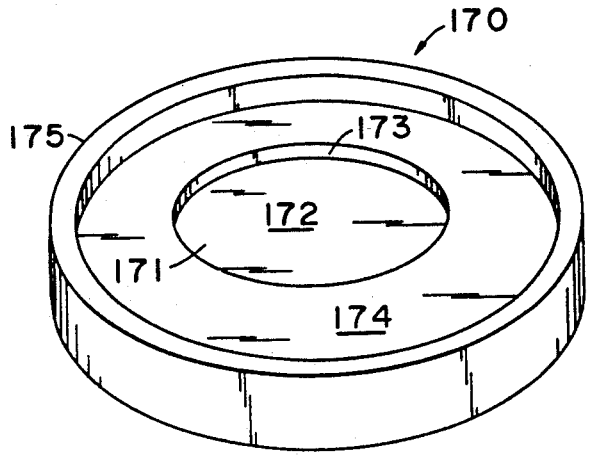
FIG. 9 is a slightly elevated perspective view of a circular starting block having a central recess, schematically illustrating the best embodiment of a starting block for casting a billet of aluminum in an electromagnetic force field which produces a billet-defining mold cavity in a mold with an invisible cylindrical wall.

To cast a billet most successfully, it is best to use a cylindrical starting block 170 such as one schematically illustrated in FIG. 9, having a cylindrical recess 171 counterbored coaxially for a depth in the range from about 2.5 cm to about 7.5 cm to provide a planar bottom surface 172. At the start of a pour the bag 300 is positioned immediately from the peripheral outlet 310 it is radially confined in the recess until it overflows its walls 173 and spills over onto the planar horizontal surface 174. The planar surface 174 is preferably bounded by a peripheral rim 175 which extends a short distance in the range from 2.5 cm to 7.5 cm above the surface 174.

It will now be evident that the bag-in-a-bag, whether rectangular or cylindrical, is preferably made from refractory fiber to allow the bag to be discarded after use. The flexibility of the bag stems from the materials of its construction and is unrelated to its effectiveness for the purpose at hand. It is not necessary to discard the bag if it is made of a high temperature metal alloy which is unreactive with molten aluminum, and the economics of using a rigid, reusable, but far more expensive bag-in-a-bag justify its use.

Figure 6:
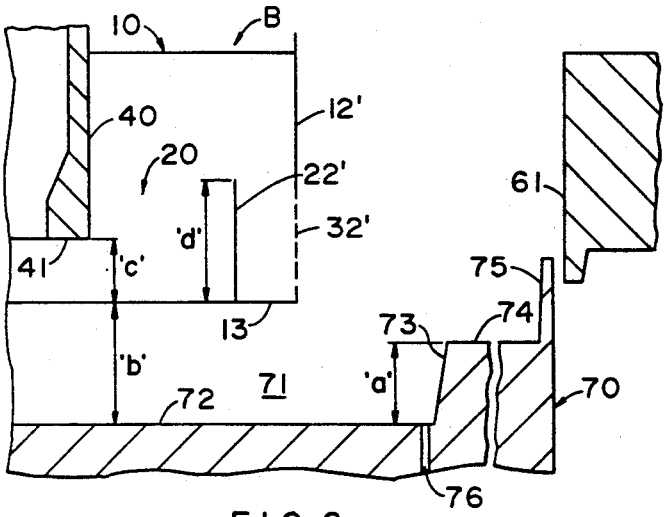
FIG. 6 is a cross-sectional elevational view with portions broken away, of a stepped starting block (with a channel recess) having a rectangular cross section and the relative position of the spout and bag-in-a-bag in the mold cavity just prior to DC casting an ingot conventionally.
Figure 7:
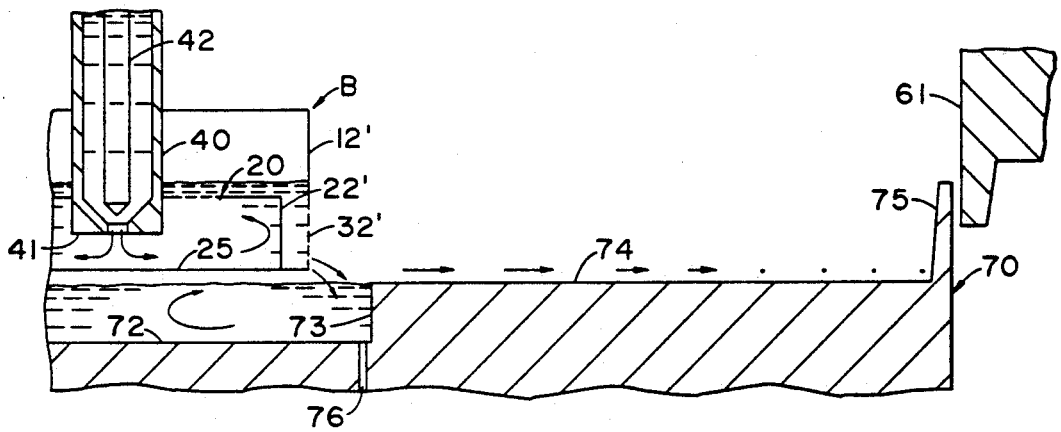
FIG. 7 is a cross-sectional elevational view with portions broken away, of a stepped starting block, and specifically a rectangular one having a rectangular central recess, and the submerged spout within the bag-in-a-bag.
Figure 8:
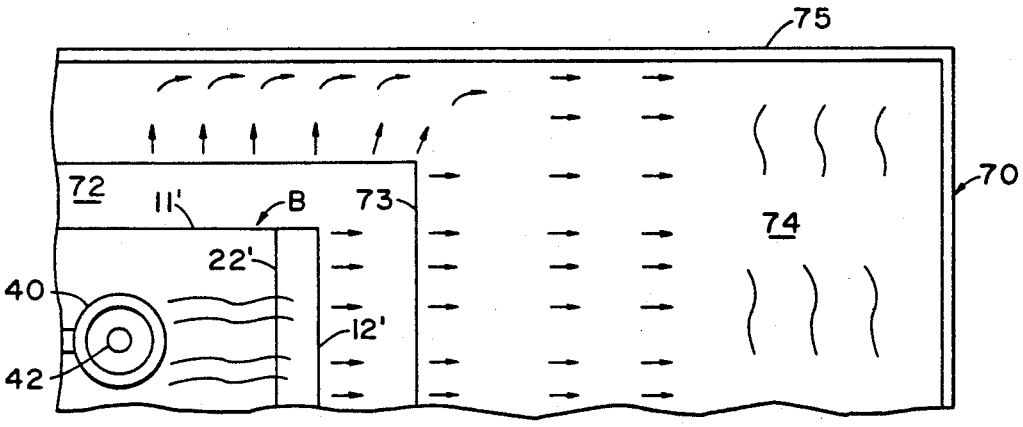
FIG. 8 is a plan view of the flow pattern of melt discharged from the bag-in-a-bag in FIG. 7, the pattern showing melt being directed along and between longer lateral sides of a rectangular mold until the melt reaches the shorter transverse sides of the mold, but does not show reverse flow.

Referring to FIGS. 6–8, there is illustrated the best mode of positioning the bag B in a conventional mold cavity for the production of a standard aluminum ingot having a horizontal cross-section at right angle to its longitudinal axis, of 20"×40" (51 cm×102 cm), in a direct chill casting. In the side elevational partial cross-section view shown, the bag B is rectangular having a planar base 13, in this specific example, about 14" (36 cm) long and 6" (15 cm) wide, positioned so that the longer sides of the planar base are at right angles to the shorter walls (one of which 61 is shown) of a generally rectangular mold; and, the longer sides of the planar base are parallel to the longer sides of a rectangular starting block 70 confined within the walls of the mold.

As illustrated in FIGS. 6 and 7, the starting block 70 is a thick rectangular slab of aluminum 6061 alloy in which a shallow well or channel (shown) 71 having a bottom surface 72 and transverse vertical walls (one of which 73 is shown) having a height 'a', is cut. The height 'a' of the walls is typically in the range from about 2.5 cm (1 in) to 7.5 cm (3 in) which is sufficient to provide the initial restriction of flow of melt confining substantially all the melt when it is first introduced into the mold cavity, before it overflows onto the generally horizontal surface, whether it is planar or slightly inclined relative to the centerplane (surface as in a conventional starting block).

A deeper channel does not appreciably improve the flow pattern provided by the specified range of depth of the channel while unnecessarily increasing the possibility of enduring sporadic "bumpings" due to the accumulation of ingot cooling water inside the channel, typically by leakage around the sides, before the butt of the ingot is sufficiently cooled. The channel 71 is constructed so that melt fills it, then spills over the walls 73 onto the laminar horizontal surface 74, stepped above the bottom surface 72 without surging in waves. It will be evident that a shallow well with generally upright walls will function in essentially the same manner as the channel to provide the desired restriction of flow.

The lower end 41 of the spout 40 is centrally positioned in the inner bag 20 of the bag B the planar base 13 of which is in turn, positioned at a height 'b' equal to or slightly greater than 'a', in the range from about 3 cm (1.25") to about 7.5 cm (3"), and the base 13 is centrally positioned over the bottom 72 of the channel 71 in the starting block. The lower end 41 is positioned at a height greater than 'a' but less than the height 'd' of the partition 22'. The lower end is preferably positioned in the range from about 1 cm to about 5 cm above the planar base 13. The height 'd' of the partition is preferably in the range from about 6 cm to 12 cm, and the height of the outlet 32' above the base 13 is preferably greater than one-half the height of the partition 22'.

At the start of a cast, with the relative disposition of the spout 40 in bag B above the starting block 70 shown in Fig 4, a control rod 42 is raised to allow melt to stream into the end 41 of the spout and overflows the partition 22' before it is discharged through outlet 32, in discharge header 30' into channel 71. The melt is restricted by the walls 73 of the channel and is redirected into the central portion of the channel where the kinetic energy of the melt is further dissipated before it overflows the channel onto the laminar portion 74 of the starting block. By the time the melt reaches the rim 75 of the starting block it has so little kinetic energy that it stagnates against the rim instead of reversing flow. One or more drain holes 76 are provided in the starting block to drain cooling water which may find its way onto the starting block.

The plan view with directional arrows shown in FIG. 8 depicts the pattern of flow of the melt during the initial phase of a cast as described above. I found that there is a close correlation between the flow patterns developed in a simulation of the cast with water, and the actual cast using molten aluminum. I confirmed the pattern shown in FIG. 8 by simulating the conditions of a cast, injecting dye above the starting block at spaced apart intervals into the water, and making a video recording of the distribution of the dye.

Figure 10:
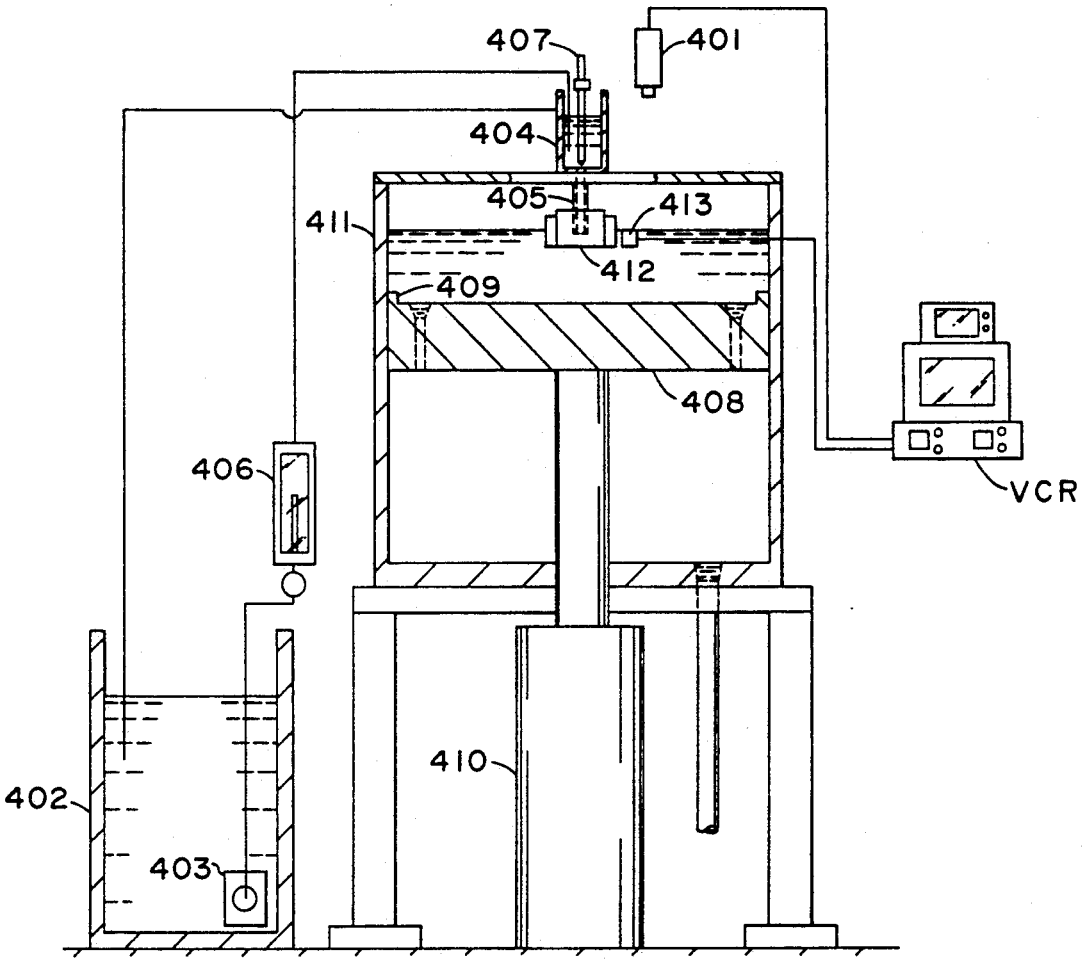
FIG. 10 is a diagrammatic partial cross-sectional elevational view illustrating the simulation (with water) of a DC casting of molten aluminum in a full scale mold while video recording the effects of varying flow conditions and varying relative dispositions of the spout, bag and starting block.

Simulation: A full scale model of a DC casting apparatus is constructed as schematically illustrated in FIG. 10 with the major components including a water delivery system, the mold and starting block, the bag B, and video recording system VCR including a camera 401, timer (not shown), and television monitor.

The water delivery system included a 150 gal water reservoir 402, a sump pump 403, a 14" wide, 24" long, and 13" deep trough 404 with a spout 405 attached to the trough's bottom. Flow through the spout into a bag-in-a-bag 412 is measured with a flow meter 406. The vertical position of the control rod 407 inside the spout regulated the water flow rate leaving the spout. The spout, full open, delivered up to 25 gal/min) (5773 $in^3$/min) with the rod raised to its maximum. This is equivalent to the volume flow rate for the 4.8 in/min drop rate of a 20" by 60" ingot.

A starting block 408 with a 1" deep channel 409, the walls of which paralleled the shorter sides of the starting block and were spaced about 12" therefrom, was placed on a hydraulic ram 410 operated at a controllable speed up to 8 in/min. Vertical walls 411 surrounded the starting block as they would in an actual DC casting. A transparent window was provided and appropriately positioned in a side wall to view and record with camera 413 the flow patterns developed during a run.

The patterns of flow were visualized by a dye injecting means, and recorded by a high resolution video recorder/player, an electronic timer and a TV monitor. Dye was injected in controlled amounts over a controlled amount of time with a metering pump, into two oppositely disposed manifolds, one on either side (along the x-axis) adjacent the narrower sides of the bag. Each manifold had five 0.032" diameter, 24" long flexible copper tubes through which dye was delivered to preselected locations above the starting block. Each tube was fitted with a check valve to cleanly terminate flow of dye from the tube. Two high resolution video cameras continuously recorded the pattern of flow as visually dramatized by dye droplets or squirts of dye were carried by the flowing water. The recordings were then played back in slow motion, to study the flow patterns developed.

Experimental Procedure: The bag B is positioned as desired over the discharge end of the spout and leveled. The spout is centered in the inner bag over the starting block which was raised to about 3" below the lower end of the spout. The discharge ends of ten dye injection tubes are located at desired locations, and the water trough is filled with water.

A simulated casting is started by lifting the control rod for maximum flow of water into the inner bag after which it is discharged through end outlets 32 and 32'. After there is a build-up of a layer of water about 0.25" deep in the channel of the starting block, dye droplets or squirts of dye, are intermittently injected and their flow paths continuously recorded. When the bag is about one-half submerged into the pool of water on the starting block, it is lowered at pre-set constant speed (normally 2"/min). The top surface of the pool is maintained at a constant position by adjusting the position of the control rod inside the spout to match the water discharge rate from the spout to the drop rate of the starting block. When the patterns of flow are too intermingled to be distinguished, the run is terminated.

Runs: Runs were made with a COMBO bag, a MINI bag, and a bag B of this invention with three geometries for starting blocks, namely (i) a central channel 1" deep and 3 ft wide, (ii) a center well 12" by 24" and 2" deep, and (iii) a flat upper surface.

The bag B having shown the desired flow pattern, a full scale actual casting is made with a 10,000 lb melt of 5182 alloy. This alloy is selected because its high magnesium content (about 4–5%) is known to make it highly susceptible to oxidation. A starting block 20" by 40" with a 2" high rim is used to cast a 100" long (high) ingot The cast was started with an initial casting speed of 1.8"/min, then increased to 2"/min after steady state was achieved. The high resolution camera was used to record the flow on the starting block continuously.

The run is repeated with a COMBO bag and a MINI bag.

Results: The ingot formed with bag B is found to be free of butt cracks and visually observable surface defects; and, to have a lower oxide content near the bottom than the ingots formed with either the COMBO bag or the MINI bag, the COMBO bag causing the highest defects.

The term "observable reverse flow" has been used because such flow is clearly visible when it occurs at the rim of a starting block, or at the walls of a mold, in the foregoing simulation of actual casting conditions for molten aluminum. It will readily be recognized that observing the occurrence of reverse flow during an actual cast may be exceedingly difficult. Nevertheless, excellent corroboration of the results obtained with the simulation is provided by observing the quality of an ingot cast under the process conditions of my process. Such observations indicate that the surface defects of an ingot or billet cast with my process are fewer than those observed with a conventional casting, whether a DC casting or an electromagnetic. Most evident is the excellent quality of the butt of an ingot cast with a bag-in-a-bag using my process in combination with a recessed starting block.

Having thus clearly and objectively stated the problem to be solved, and its solution by the invention disclosed herein, and having provided a detailed description and illustrations of the best mode of practicing the invention, it is understood that no undue restrictions are to be imposed by reason thereof, and particularly that the invention is not restricted to a slavish adherence to the details set forth herein.

I claim:

1. A melt distribution bag adapted for use under a spout the discharge end of which is positioned to discharge said melt to form an ingot of generally rectangular cross section which ingot is to be cast in an ingot-defining mold cavity, said bag comprising, an essentially pressureless box-shaped receptacle having a substantially planar base member and upstanding side and end walls rising from the periphery of said base member forming an outer bag which is partitioned to provide at least two opposed, spaced-apart discharge zones at each end of said outer bag;

an essentially melt-impermeable inner bag centrally disposed upon said base member, said inner bag being defined by upstanding laterally spaced apart partitions which connect said side walls so as to retain a pool of said melt within said inner bag;

at least each said end wall having near the bottom thereof, a discharge outlet having a filtration member through which said melt is discharged into said mold cavity.

2. The melt distribution bag of claim 1 wherein said melt is discharged laterally from opposed discharge outlets, the combined area of said discharge outlets being sufficiently large to filter said melt into said mold cavity without providing substantial accumulation of said melt within said discharge zones.

3. The melt distribution bag of claim 1 wherein said end walls are shorter than said side walls.

4. The melt distribution bag of claim 2 wherein said filtration member is an open-mesh screen of woven refractory fiber, said screen having openings small enough to trap particles so large as to result in a noticeable and unacceptable defect in the ingot cast.

5. The melt distribution bag of claim 4 wherein said partitions are from about one-fifth to one-half the height of said end walls.

6. The melt distribution bag of claim 5 wherein said outer bag is formed from closely woven yarn of refractory fiber, and the open area of said discharge outlets is sufficient to provide a discharge velocity of melt in the range from about 40 in/min to about 100 in/min.

7. The melt distribution bag of claim 6 wherein each said discharge zone has plural discharge outlets.

8. The melt distribution bag of claim 7 wherein each said discharge zone has an outlet having a filtration member in said base member.

9. The melt distribution bag of claim 7 wherein said discharge zone has an outlet having a filtration member in said side wall.

10. The melt distribution bag of claim 1 wherein said side walls terminate at their upper periphery in sleeves to facilitate positioning said outer bag under said spout.

11. A generally rectangular melt-distribution receptacle adapted to be disposed in melt-receiving relationship under the discharge end of a melt-feeding spout, said receptacle having a planar base and upstanding opposed side walls and end walls, said end walls being shorter than said side walls; a central zone provided by laterally spaced-apart upstanding partitions extending transversely from one side wall to the other and upwardly for a shorter distance than the height of said end walls; and, at least each end wall has an open-mesh discharge outlet near the bottom of the end wall so as to allow melt to be discharged laterally from opposed discharge outlets.

12. The melt distribution receptacle of claim 11 wherein the combined area of said discharge outlets is sufficiently large to provide substantially no accumulation of melt other than within said central zone, so that melt is continuously filtered and discharged through said outlets with essentially no pressure drop.

13. The melt distribution receptacle of claim 12 wherein said partitions are from about one-fifth to one-half the height of said end walls.

14. The melt distribution receptacle of claim 11 wherein said side walls terminate at their upper periphery in sleeves to facilitate positioning said inner bag under said spout.

15. A melt distribution bag adapted for use under a spout the discharge end of which is positioned above the center of a mold in which a billet of generally cylindrical cross section is to be cast in a substantially cylindrical mold cavity, said bag comprising, an open-top generally cylindrical outer bag having a substantially planar circular base member and a peripheral outer wall rising from the periphery of said base member; an essentially melt-impermeable inner bag disposed upon said base member and within said outer bag, said inner bag being defined by a cylindrical inner wall rising from said base member so as to retain a pool of said melt large enough to submerge a melt-discharging spout within said inner bag;

said cylindrical inner wall and said peripheral outer wall providing an annular discharge zone into which melt overflows from said inner bag, said inner wall having a circumferential discharge outlet having a filtration member in said peripheral outer wall near the bottom thereof, the area of said discharge outlet being sufficiently large to filter said melt into said mold cavity without providing substantial accumulation of said melt within said discharge zone.

16. The melt distribution bag of claim 15 wherein said filtration member is an open-mesh screen.

17. The melt distribution bag of claim 15 wherein said inner wall is from about one-fifth to one-half the height of said peripheral outer wall.

18. The melt distribution bag-in-bag of claim 17 wherein said discharge zone has an outlet having a filtration member peripherally disposed in said circular base member.

19. A melt-distribution receptacle adapted to be disposed in melt-receiving relationship under the discharge end of a melt-feeding spout, said receptacle having a planar base and upstanding opposed side walls and end walls, said end walls being shorter than said side walls; a central zone provided by laterally spaced-apart upstanding partitions from about one-fifth to one-half the height of said end walls, said partition extending transversely from one side wall to the other and upwardly for a shorter distance than the height of said end walls, and, at least each end wall has an open-mesh discharge outlet near the bottom of the end wall so as to allow melt to be discharged laterally from opposed discharge outlets having a combined open area sufficiently large to provide a discharge velocity of melt in the range from about 40 in/min to about 100 in/min with substantially no accumulation of melt other than within said central zone, so that melt is continuously filtered and discharged through said outlets with essentially no pressure drop.

20. A melt distribution bag adapted for use under a spout the discharge end of which is positioned above the center of a mold in which a billet is to be cast in a mold cavity, said bag comprising, an open-top bag having a substantially planar base member and a peripheral outer wall rising from the periphery of said base member;

an essentially melt-impermeable inner bag disposed upon said base member and within said outer bag, said inner bag being defined by an inner wall from about one-fifth to one-half the height of said peripheral outer wall, said inner wall rising from said base member so as to retain a pool of said melt large enough to submerge a melt-discharging spout within said inner bag;

said inner wall and said peripheral outer wall providing an annular discharge zone into which melt overflows from said inner bag, said inner wall having a discharge outlet having an open mesh screen in said peripheral outer wall near the bottom thereof, the area of said discharge outlet being sufficient to filter said melt into said mold cavity, and to provide a discharge velocity of melt from an outlet in the range from about 40 in/min to about 100 in/min.

* * * * *